US005746044A

United States Patent [19]

Draghetti

[11] Patent Number: 5,746,044

[45] Date of Patent: May 5, 1998

[54] PRODUCT WRAPPING METHOD

[75] Inventor: Fiorenzo Draghetti, Medicina, Italy

[73] Assignee: G.D Societa Per Azioni, Bologna, Italy

[21] Appl. No.: 792,583

[22] Filed: Jan. 30, 1997

[30] Foreign Application Priority Data

Jan. 31, 1996 [IT] Italy ..... BO96A0039

[51] Int. Cl.[6] ..... B65B 11/30

[52] U.S. Cl. ..... 53/461; 53/202; 131/105; 131/107; 131/108

[58] Field of Search ..... 131/105, 107, 131/108, 94; 53/168, 202, 461

[56] References Cited

FOREIGN PATENT DOCUMENTS 309818 4/1989 European Pat. Off. ..... 131/105

130574 2/1963 France ..... 131/105

302568 10/1965 Netherlands ..... 131/105

*Primary Examiner*—V. Millin

*Assistant Examiner*—Charles W. Anderson

*Attorney, Agent, or Firm*—Ladas & Parry

[57] ABSTRACT

A method of wrapping products, whereby gripping assemblies, each for receiving a respective product and a respective sheet of wrapping material, are fed successively in steps and in a given traveling direction along a path extending through a loading station where each assembly is supplied with a respective sheet of wrapping material; and whereby, at each step, two assemblies, located one behind the other along the path, are brought into the loading station and arrested in respective loading positions to simultaneously receive respective sheets of wrapping material, which are fed to the respective loading positions along respective supply paths located side by side.

8 Claims, 2 Drawing Sheets

PRODUCT WRAPPING METHOD

BACKGROUND OF THE INVENTION

The present invention relates to a product wrapping method.

The present invention may be used to advantage on cigarette wrapping machines, in particular machines for wrapping packets of cigarettes, to which the following description refers purely by way of example.

On known wrapping machines, the packets are fed in steps through a loading station where they are paired with respective sheets of wrapping material in which they are wrapped at follow-up wrapping stations. As known loading stations receive one packet at a time, any increase in the number of packets formed per unit of time means increasing the speed at which each packet is fed to the loading station. On the other hand, the rate at which the packets are fed to the loading station can only be increased so far without generating severe vibration capable of impairing operation of the machine, and a noise level over and above the limit permitted in working environments.

SUMMARY OF THE INVENTION

It is an object of the present invention to provide a method enabling an increase in output while at the same time maintaining an acceptable level of vibration.

According to the present invention, there is provided a method of wrapping products, the method comprising the stages of conveying in steps, in a first given direction and along a given path, a succession of gripping assemblies, each for receiving a respective product and a respective sheet of wrapping material, the path extending through a loading station in which each said assembly receives a respective said sheet of wrapping material; the method being characterized in that, at each step, two assemblies, located one behind the other along said path, are brought into the loading station and arrested in respective loading positions to simultaneously receive respective said sheets; the respective sheets of said two assemblies being fed to the respective loading positions along respective supply paths located side by side.

The above method therefore not only provides for achieving the proposed object, but also for indirectly providing a highly straightforward low-cost solution to the problems typically associated with dual packing machines.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
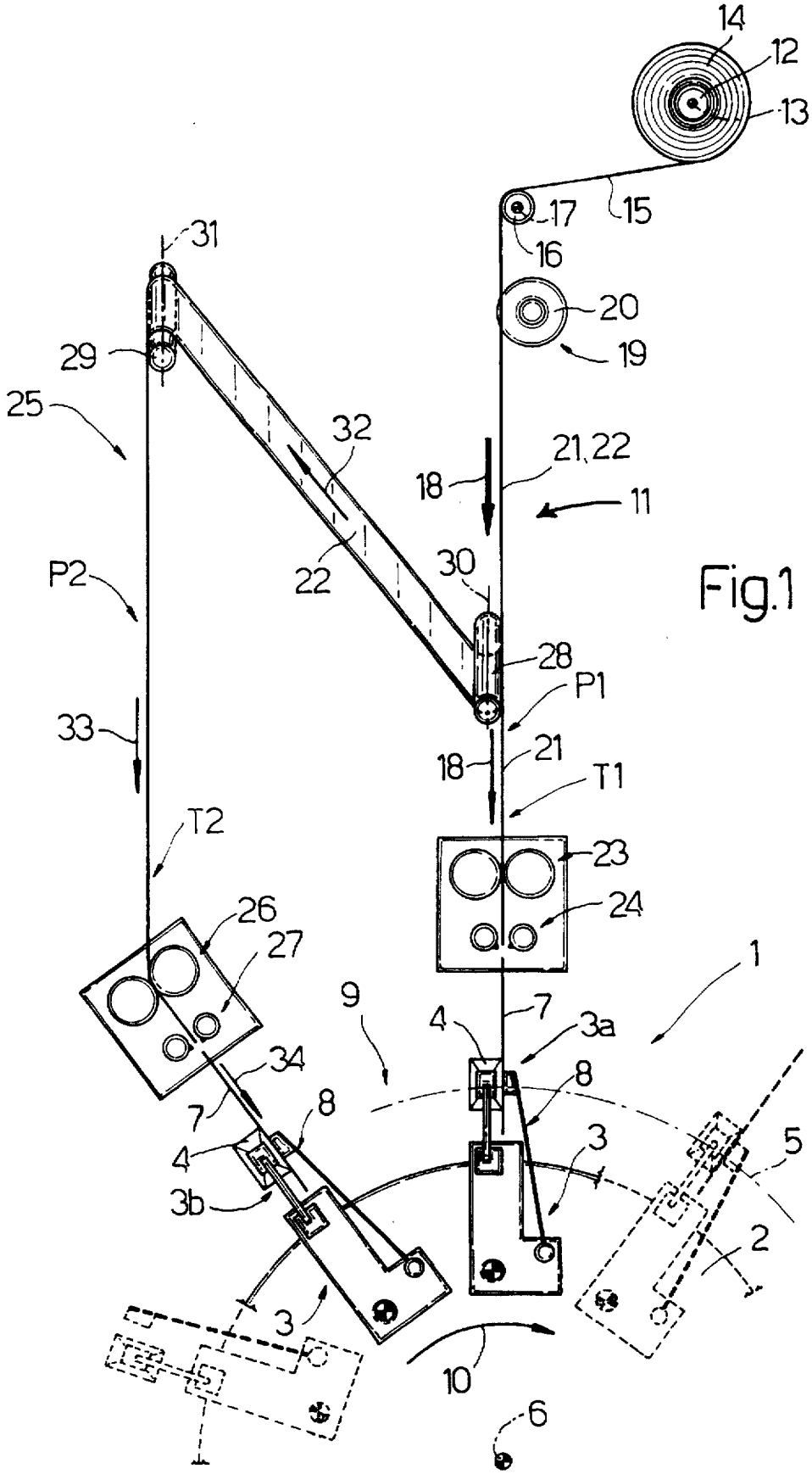
FIG. 1 shows a schematic side view of a wrapping machine implementing the method according to the present invention.

Number 1 in FIG. 1 indicates a wrapping machine comprising a wrapping wheel 2 presenting a number of known gripping assemblies 3 equally spaced about the periphery of wheel 2, and each for conveying a respective packet 4 along a circular path 5 extending about an axis 6 and through a number of folding stations (not shown), at each of which a sheet 7 of wrapping material, retained by a gripping element 8 forming part of assembly 3, is subjected to at least one folding operation to form a wrapping (not shown) about packet 4.

As shown in FIG. 1, path 5 extends through a loading station 9 for loading sheets 7 on to wheel 2; wheel 2 moves in steps about axis 6 and, at each step, arrests two adjacent assemblies 3 in respective loading positions 3*a* and 3*b* inside station 9, which is located upstream from said folding stations (not shown) in the traveling direction 10 of assemblies 3.

Machine 1 also comprises a supply unit 11 for feeding a succession of pairs of sheets 7 to station 9 and simultaneously feeding respective sheets to the two assemblies 3 arrested, at each step of wheel 2, inside station 9.

Unit 11 comprises a reel supporting pin 12 mounted in a fixed position, rotating in braked manner, by means of a known brake (not shown), about an axis 13 parallel to axis 6, and supporting a reel 14 of a double strip 15 of a width L equal to twice the width L1 of sheets 7.

Unit 11 also comprises a guide roller 16 mounted in a fixed position and rotating about an axis 17 parallel to axis 13 to guide double strip 15 in a direction 18, which is substantially radial in relation to wheel 2 and directed towards loading position 3*a* through a longitudinal cutting station 19 where double strip 15 is engaged by a circular blade 20 and cut longitudinally in half into two single strips 21 and 22, each of a width equal to width L1.

As shown in FIG. 1, single strip 21 is fed to loading position 3*a* in direction 18, along a respective straight path P1 and in a plane T1 coplanar with the plane of double strip 15 at cutting station 19, and via a known traction assembly 23 and a known cutting assembly 24 for cutting single strip 21 transversely into a succession of respective sheets 7. Single strip 22, on the other hand, is fed to loading position 3*b* along a respective path P2 extending through a guide device 25, a known traction assembly 26, and a known cutting assembly 27 for cutting single strip 22 transversely into a succession of sheets 7.

Figure 2:
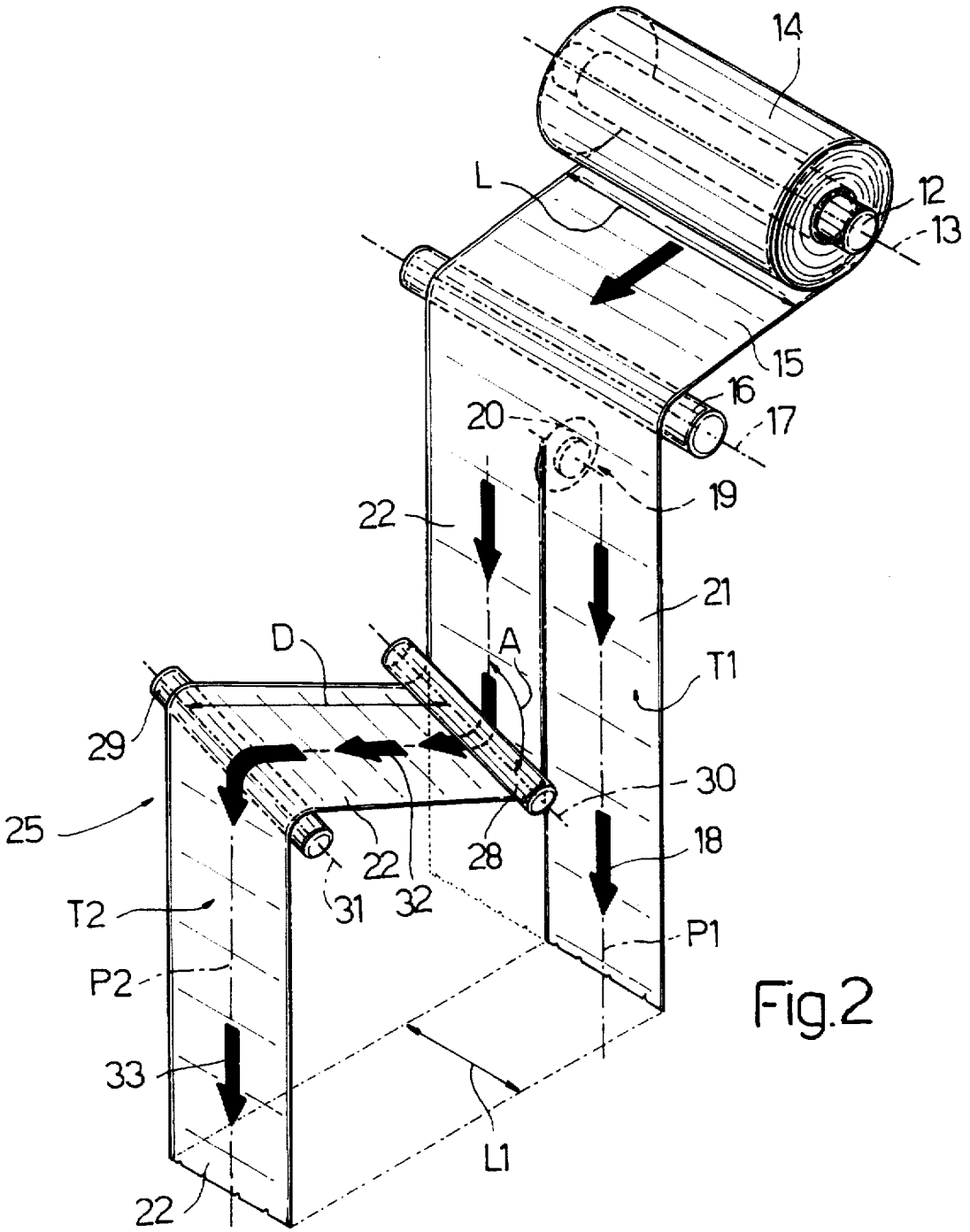
FIG. 2 shows a schematic view in perspective of a detail of the FIG. 1 machine.

As shown in FIGS. 1 and 2, guide device 25 provides for guiding single strip 22 from a position wherein it is coplanar and side by side with single strip 21 immediately downstream from cutting station 19, to a position wherein it is located over single strip 21. For which purpose, guide device 25 comprises two cylindrical rollers 28 and 29, the first of which is tangent to plane T1, and the second of which is parallel to plane T1 and roller 28, and is arranged away from plane T1. Rollers 28 and 29 rotate in opposite directions about respective parallel axes 30 and 31, which are substantially crosswise to direction 18, are inclined towards single strip 21 and in direction 18, and, when projected in plane T1, form with direction 18 an angle A given by the equation:

$$\cos A = L1/D$$

where D is the distance between axes 30 and 31, and L1 the width of strips 21 and 22.

More specifically, single strip 22 winds (clockwise in FIG. 1) beneath roller 28, by which it is diverted, in a direction 32 perpendicular to axes 30 and 31 and substantially crosswise to plane T1, from plane T1 to roller 29, which is tangent to a plane T2 parallel to plane T1 and facing strip 21. At plane T2, single strip 22 winds (anticlockwise in FIG. 1) over roller 29, by which it is diverted, in plane T2 and in a direction 33 parallel to direction 18, to traction assembly 26, by which it is further diverted to loading position 3*b* in a direction 34 radial in relation to wheel 2.

Along the portion of respective path P2 extending along plane T2, strip 22 is therefore positioned parallel to and over strip 21, i.e. in such a position as to be fed to station 9 simultaneously with strip 21, and to enable wheel 2 to halve its stop rate for a given output.

I claim:

1. A method of wrapping products (4), the method comprising the stages of conveying in steps, in a first given direction (10) and along a given path (5), a succession of gripping assemblies (3), each for receiving a respective product (4) and a respective sheet (7) of wrapping material, the path (5) extending through a loading station (9) in which each said assembly (3) receives a respective said sheet (7) of wrapping material; the method being characterized in that, at each step, two assemblies (3), located one behind the other along said path (5), are brought into the loading station (9) and arrested in respective loading positions (3*a*, 3*b*) to simultaneously receive respective said sheets (7); the respective sheets (7) of said two assemblies (3) being fed to the respective loading positions (3*a*, 3*b*) along respective supply paths (P1, P2) located side by side.

2. A method as claimed in claim 1, characterized in that the sheets (7) fed to each loading position (3*a*, 3*b*) are formed by transversely cutting a respective strip (21; 22) fed to the respective loading position (3*a*, 3*b*) along a respective said supply path (P1; P2).

3. A method as claimed in claim 2, characterized in that said two strips (21, 22) are formed by feeding a double strip (15), of a width equal to twice the width of said strips (21, 22), in an axial direction (18) through a cutting station (19) to cut the double strip (15) longitudinally in half; at least a first (22) of the two strips (21, 22) being diverted from a position coplanar and side by side with a second (21) of the two strips (21, 22), to a position over the second strip (21).

4. A method as claimed in claim 3, characterized in that said first strip (22) is diverted by a first (28) and second (29) roller, the axes (30, 31) of which are substantially crosswise to said axial direction and inclined in said axial direction (18) and towards the second strip (21); the first strip (22) being wound about the two rollers (28, 29) so that, in use, the rollers (28, 29) rotate in opposite directions in relation to each other.

5. A method as claimed in claim 4, characterized in that said two strips (21, 22) are located in a same first plane (T1) upstream from said first roller (28) in said axial direction (18); the first strip (22) being diverted by the first roller (28) in a direction (32) substantially crosswise to the first plane (T1).

6. A method as claimed in claim 5, characterized in that the first strip (22) is diverted by the second roller (29) into a second plane (T2) substantially parallel to the first plane (T1).

7. A method as claimed in claim 6, characterized in that said first strip (22) is fed in said second plane (T2) in a direction (33) parallel to said axial direction (18).

8. A method as claimed in claim 1, characterized in that said two supply paths (P1, P2) are substantially perpendicular to said path (5) of the products (4) in the respective said loading positions (3*a*, 3*b*).

* * * * *